US009473861B1

(12) United States Patent
Ryan et al.

(10) Patent No.: US 9,473,861 B1
(45) Date of Patent: Oct. 18, 2016

(54) METHOD OF FORMING A SEMICONDUCTOR DEVICE AND STRUCTURE THEREFOR

(71) Applicant: SEMICONDUCTOR COMPONENTS INDUSTRIES, LLC, Phoenix, AZ (US)

(72) Inventors: James Gregory Ryan, Ottawa (CA); Dennis Wayne Mitchler, Ottawa (CA)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 14/856,040

(22) Filed: Sep. 16, 2015

(51) Int. Cl.
*H04R 25/00* (2006.01)
*H04R 31/00* (2006.01)

(52) U.S. Cl.
CPC ..... *H04R 25/558* (2013.01); *H04R 25/554* (2013.01); *H04R 31/00* (2013.01)

(58) Field of Classification Search
CPC .. H04R 25/558; H04R 25/554; H04R 31/00; H04R 2420/05; H04R 2420/03
See application file for complete search history.

(56) References Cited

U.S. PATENT DOCUMENTS 6,813,363 B2 11/2004 Vonlanthen
7,286,678 B1 10/2007 Bachler et al.
8,351,627 B2 1/2013 Chan et al.
9,008,341 B2 4/2015 Ryan
2004/0047483 A1 3/2004 Bauman
2006/0256987 A1 11/2006 Beilin
2007/0009124 A1* 1/2007 Larsen ..... H04R 25/554 381/315
2008/0008340 A1 1/2008 Bachler et al.
2008/0260193 A1 10/2008 Westermann et al.
2009/0052706 A1 2/2009 Gottschalk et al.
2009/0103754 A1 4/2009 Gottschalk et al.
2010/0067707 A1 3/2010 Schwerdtner
2010/0111315 A1 5/2010 Kroman
2010/0208906 A1 8/2010 Vonlanthen
2011/0002489 A1 1/2011 Schefer
2011/0156898 A1* 6/2011 Taillefer ..... G08B 1/08 340/539.11
2013/0251179 A1* 9/2013 Aschoff ..... G06F 8/31 381/314
2015/0125013 A1* 5/2015 Secall ..... G10L 19/167 381/315
2015/0139459 A1* 5/2015 Olsen ..... H04R 1/1091 381/315

* cited by examiner

*Primary Examiner* — Tuan D Nguyen
(74) *Attorney, Agent, or Firm* — Robert F. Hightower

(57) ABSTRACT

In one embodiment, a semiconductor device may include a controller that may be configured to receive an information signal from a detachable device wherein the information signal may be selectively representative of an output signal of the controller according to codes of the detachable device and to receive a sense input that may be representative of the output signal and to determine a code received from the detachable device according to a value of the sense signal and the information signal.

20 Claims, 5 Drawing Sheets

| | | In 1, In 0 Values For | | |
|---|---|---|---|---|
| Connection 44 | Connection 43 | Out +, Out - = 0,1 | Out +, Out - = 1,0 | Code |
| Open | Open | 00 | 00 | 0 |
| Open | To 38 (out +) | 00 | 01 | 1 |
| Open | To 39 (out -) | 01 | 00 | 4 |
| To 38 (out +) | Open | 00 | 10 | 2 |
| To 38 (out +) | To 38 (out +) | 00 | 11 | 3 |
| To 38 (out +) | To 39 (out -) | 01 | 10 | 6 |
| To 39 (out -) | Open | 10 | 00 | 8 |
| To 39 (out -) | To 38 (out +) | 10 | 01 | 9 |
| To 39 (out -) | To 39 (out -) | 11 | 00 | 12 |

*FIG. 4*

METHOD OF FORMING A SEMICONDUCTOR DEVICE AND STRUCTURE THEREFOR

BACKGROUND OF THE INVENTION

The present invention relates, in general, to electronics, and more particularly, to hearing aid devices and/or personal sound amplification devices, structures thereof, semiconductor devices, and methods of forming such devices.

In the past, hearing aids were manufactured to assist people with hearing difficulties. Some hearing aids included detachable receivers that included a loudspeaker of the hearing aid. Various methods were provided for a controller portion of the hearing aid to determine the type of receiver that was attached to the controller. In some systems audible noise may be formed during the process of identifying the type of receiver that was attached. The audible noise often could be heard by a person wearing the hearing aid and could be annoying to the hearing aid user.

Accordingly, it is desirable to have a detection apparatus and method that may reduce the audible noise.

BRIEF DESCRIPTION OF THE DRAWINGS

FIG. 4 illustrates a table with examples of some values or alternately states of some of the signals formed by the system of FIG. 2 in accordance with the present invention.

Figure 1:
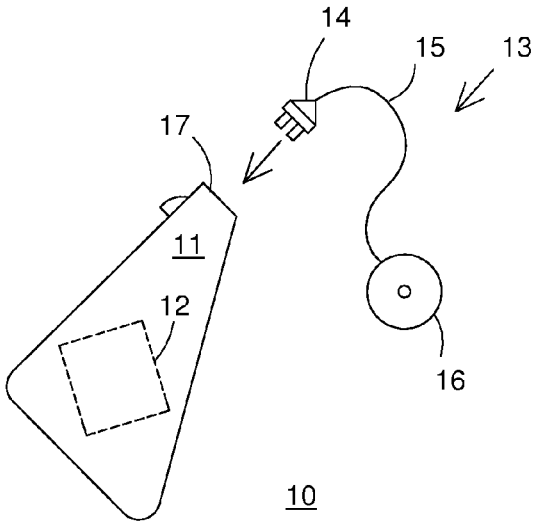
FIG. 1 illustrates an example of a portion of an embodiment of a hearing aid system in accordance with the present invention.

For simplicity and clarity of the illustration(s), elements in the figures are not necessarily to scale, some of the elements may be exaggerated for illustrative purposes, and the same reference numbers in different figures denote the same elements, unless stated otherwise. Additionally, descriptions and details of well-known steps and elements may be omitted for simplicity of the description. It will be appreciated by those skilled in the art that the words during, while, and when as used herein relating to circuit operation are not exact terms that mean an action takes place instantly upon an initiating action but that there may be some small but reasonable delay(s), such as various propagation delays, between the reaction that is initiated by the initial action. Additionally, the term while means that a certain action occurs at least within some portion of a duration of the initiating action. The use of the word approximately or substantially means that a value of an element has a parameter that is expected to be close to a stated value or position. However, as is well known in the art there are always minor variances that prevent the values or positions from being exactly as stated. It is well established in the art that variances of up to at least ten percent (10%) are reasonable variances from the ideal goal of exactly as described. When used in reference to a state of a signal, the term "asserted" means an active state of the signal and the term "negated" means an inactive state of the signal. The actual voltage value or logic state (such as a "1" or a "0") of the signal depends on whether positive or negative logic is used. Thus, asserted can be either a high voltage or a high logic or a low voltage or low logic depending on whether positive or negative logic is used and negated may be either a low voltage or low state or a high voltage or high logic depending on whether positive or negative logic is used. Herein, a positive logic convention is used, but those skilled in the art understand that a negative logic convention could also be used. The terms first, second, third and the like in the claims or/and in the Detailed Description of the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein. Reference to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but in some cases it may. Furthermore, the particular features, structures or characteristics may be combined in any suitable manner, as would be apparent to one of ordinary skill in the art, in one or more embodiments.

DETAILED DESCRIPTION OF THE DRAWINGS

FIG. 1 illustrates an example of a portion of an embodiment of a hearing aid system 10. One example of a hearing aid is disclosed in U.S. Pat. No. 9,008,341 issued to James Ryan which is hereby incorporated herein by reference. In one embodiment, hearing aid system 10 can include a hearing aid component or circuit or hearing aid shell 11 and a detachable receiver 13. In one embodiment, component 11 can include various circuits such as for example, a controller 12, one or more amplifier circuits, one or more processing circuits, a driver circuit, a microphone, a battery compartment, a battery, push buttons, or other user controls. For example, an embodiment of controller 12 may include one or more amplifier circuits, and/or one or more processing circuits, and/or a driver circuit. In one embodiment, detachable receiver 13 can include a speaker module 16, wiring 15, and a detachable connector 14, such as for example a plug. An embodiment of component 11 may include a socket 17 or other type of connector to which connector 14 may be attached to provide signal paths between component 11 and module 16. A portion of or alternately all of module 16 may, in some embodiments, be surrounded by a soft tip designed to provide patient comfort when fitted into an ear canal.

During the operation of system 10, an electrical signal can be transferred from the circuits within hearing aid component 11 toward detachable receiver 13 via an output terminal or output. In one example embodiment, the output can be connected to an output of an amplifier circuit in component 11, such as in controller 12 for example. The electrical signals or output signals on the output terminals may be formed as analog signals or as digital signals such as pulse density modulation (PDM) signals or pulse width modulation (PWM) signals or as other digital signals. An embodiment of system 10 may include forming controller 12 with an amplifier that is configured to operate with and/or provide signals to an embodiment of module 16 that may include a receiver that may be referred to as a zero-bias receiver in order to substantially eliminate a d.c. bias on module 16. Those skilled in the art will appreciate that analog outputs or other types of digital outputs may also be used. Controller 12 may, in some embodiment, have two amplifier outputs that, in some embodiments, may be out of phase with each other.

Receiver 13 may also be configured to send information signals to component 11 or to controller 12 to assist component 11 in identifying information about receiver 13. The identification information of receiver 13 can be embodied by a connection arrangement among an encoding connection or encoding configuration and the electrical output signals from component 11. The encoding configuration can be implemented, for example, within detachable connector 14 or within module 16 or within other locations of receiver 13. The encoding configuration, thus the information, can be detected based on values or states of the drive signals and information signals received from module 16 on inputs of component 11 via the encoding configuration. If an input of component 11 is connected to any output of component 11, the input will change its state. If an input of component 11 is unconnected to any output terminal, the input will not change its state. Component 11 may include circuits to decode the information, for example, controller 12 may include a decoder for decoding the information of detachable receiver 13 based on the states of the information signals. The audio processing performed by component 11 may, in an embodiment, be adapted based on the information received from receiver 13.

Figure 2:
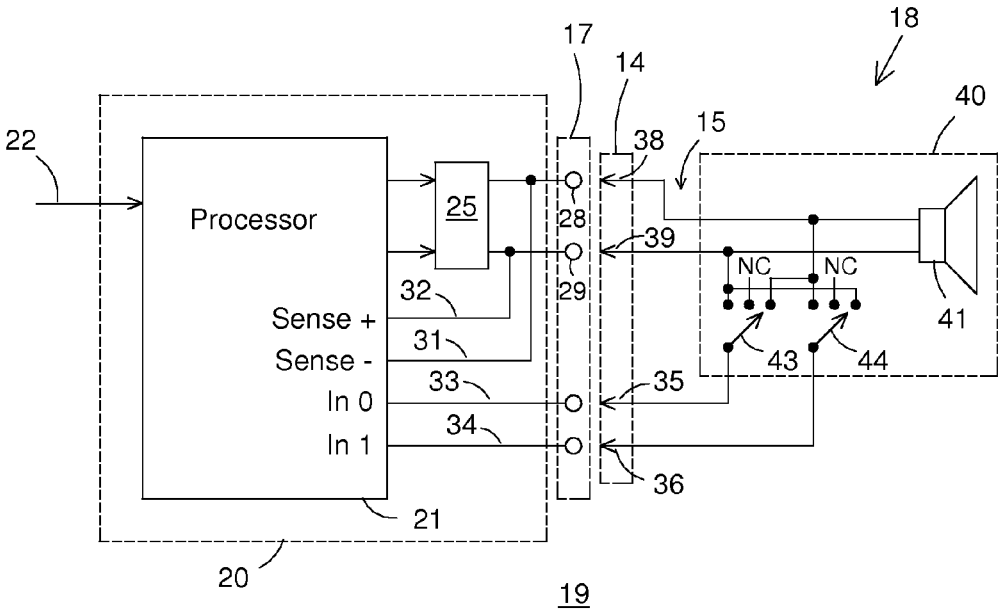
FIG. 2 schematically illustrates an example of a portion of an embodiment of a hearing aid system that can be an alternate embodiment of the system of FIG. 1 in accordance with the present invention.

FIG. 2 schematically illustrates an example of a portion of an embodiment of a hearing aid system 19 that can be an alternate embodiment of system 10. In one embodiment, system 19 may be substantially similar to system 10. System 19 includes a control circuit or controller 20 that may be an example embodiment of a portion of circuits that may be within an embodiment of component 11 (FIG. 1). In a non-limiting example, controller 20 may be an alternate embodiment of controller 12 of component 11. System 19 also includes an example of a portion of an embodiment of a detachable receiver 18 that may be an example of an alternate embodiment of receiver 13 of FIG. 1.

Controller 20 may include various processing circuits or control circuits, such as a processor circuit 21 for example, which may be configured to receive a signal 22 from a microphone or a signal that is representative of a signal from a microphone, process the received signal using various hearing aid algorithms, and form an output signal to excite receiver 18 to form audio signals that are representative of signal 22. Those skilled in the art will understand that the various algorithms executed by circuit 21 may be configured to use various parameters that are personalized to the individual hearing needs and properties of a person that uses system 19. For example, circuit 21 may include a digital signal processor (DSP) that may include one or more amplifier circuits, one or more analog-to-digital converter circuits, one or more sigma-delta converter circuits, various computer processing circuits, and/or various other known circuits used for hearing aids. Controller 20 may also include a driver circuit 25 that is configured to receive either digital or analog signals from circuit 21 and form output signals to excite receiver 18. For example, circuit 25 may, in an embodiment, include an H-Bridge circuit that converts digital signals from circuit 21 to the output signals such as for example an output+ signal or out+ and an output− signal or out− on respective output terminals or outputs 28 and 29. Outputs 28 and 29 may be detachably connected to respective input terminals or inputs 38 and 39 of connector 14 to provide an electrical path between receiver 18 and signals out+ and out−.

Receiver 18 may include a speaker module 40 that may have an embodiment that is similar to an embodiment of module 16 (FIG. 1). Module 40 may include a loudspeaker or speaker 41, input terminals or inputs 38 and 39 that are configured to receive signals out+ and out−, respectively, from controller 20, and output terminals or outputs 35 and 36 that provide information signals In0 and In1 to controller 20.

In one embodiment, receiver 18 may also include connections 43 and 44 that may be used to encode information about receiver 18. Connections 43 and 44 may be configured in various configurations to provide a path from either of signals out+ or out− to any of signals In0 or In1. For example, one of or both of terminals 35 and 36 may be connected to either one of terminals 38 and 39 by one or more of connections 43 and/or 44. Thus, either or both of terminals 35 and 36 may be configured to receive either of or none of output signals out+ and/or out−. For example, connections 43 and 44 may be used to form various cross-connections from terminals 38 and 39 to terminals 35 and 36. Controller 20 may form various output signals on out+ and out− which may be received by controller 20 as information signals In0 and In1 on inputs 33 and 34. Those skilled in the art will appreciate that connections 43 and 44 may be disposed in various locations in receive 18. For example, connections 43 and 44 may be located in various places along wring 15, or may alternated be disposed in the connector such as illustrated n FIG. 7.

Figure 3:
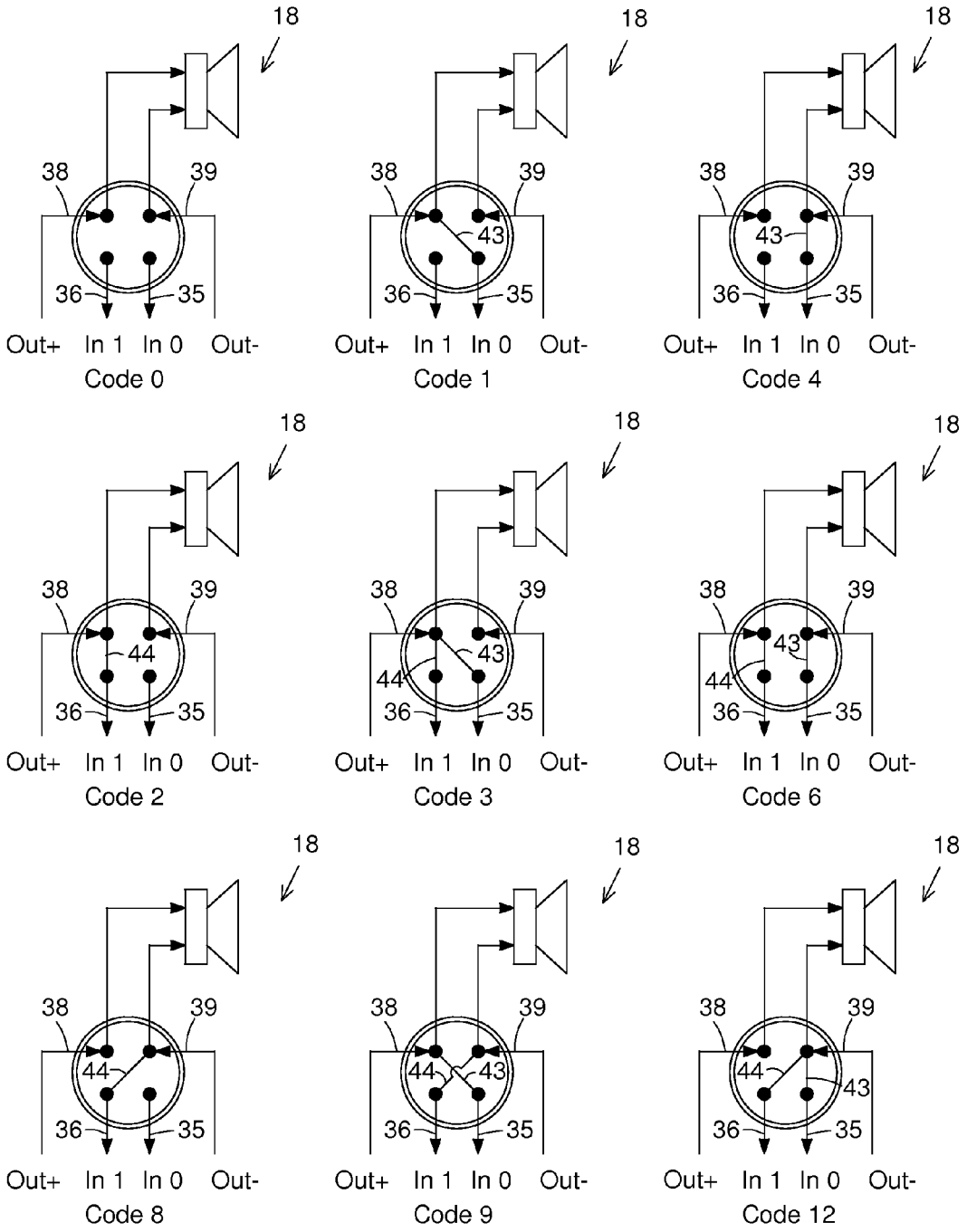
FIG. 3 schematically illustrates in a general manner nine different code configurations that may be formed by some embodiments of connections of the system of FIG. 1 and/or FIG. 2 in accordance with the present invention.

FIG. 3 schematically illustrates in a general manner nine different code configurations that may be formed by connections 43 and 44. Each code configuration has a different connection from inputs 38 and 39 to outputs 35 and 36. Because of connections 43 and 44, various values or states of signals out+ and out− form different signal configurations or states of signals In0 and In1.

FIG. 4 illustrates a table 50 illustrating examples of values or alternately states of signals In0 and IN1 that may be formed based on the configuration of connections 43 and 44 and the state or value of signals out+ and out−. This description has references to FIGS. 3 and 4. In one non-limiting example embodiment, controller 20 or circuit 21 may include a circuit (not shown) to set either of inputs 33 and 34 to a selected value if one of both of connections 43 and/or 44 are omitted, such as for example, for a code of zero. For such an example embodiment, those skilled in the art will appreciate that if signals out+ and out− are both low or at a negated state, then signals In0 and In1 will also both be at a low state regardless of the code formed by connections 43 and 44. Also, if out+ and out− are both an asserted state or at a high value, it is not possible to tell which configuration of connections 43 and 44 (FIG. 3), or codes, would cause one or both of IN0 and In1 to have an asserted state. Thus, to determine the code formed by connections 43 and 44 it is desirable to drive signals out+ and out− with opposite states. For example, out+ can be asserted and out− negated, and vice versa. The table for FIG. 4 illustrates how the various codes formed by the configurations of connections 43 and 44 may be decoded or determined.

Table 50 illustrates the various codes that can be decoded from the value of signals In0 and IN1 if the values for out+ and out− are known, according to one example embodiment of controller 20 and receiver 18. For example, as illustrated by the third and fourth columns from the left of table 50, out+ an out− are driven with opposite states. For example, according to the third column and the first row of table 50, out+ may be negated and out− asserted, and then the values of signals In0 and In1 are sensed for that set of out+ and out− values; then out+ and out− are inverted so that out+ is asserted and out− is negated, and the values of In0 and In1 are again sensed. Based on the two sets of In0 and In1 values, the code formed by connections 43 and 44 can be determined to be 0. The two different sets of out+ and out− values can be used to form two sets of In0 and In1 values that can uniquely determine any of the codes illustrated in FIGS. 3 and 4. Those skilled in the art will appreciate that in FIG. 3, the top left configuration illustrates no connections between either of inputs 38 and/or 39 and either of outputs 35 and 36, resulting in a code of zero.

Referring back to FIG. 2, circuit 21 is configured to receive signals sense+ 32 and sense− 31 that are representative of the values of signals out+ and out−, respectively. Since the value or state of signals out+ and out− are known via signals sense+ and sense−, circuit 21 can sense the value of signals In0 and In1 for the different values of out= and out− and determine the code represented by connections 43 and 44, such as illustrated in table 50. Additionally, since circuit 21 can use the sense+ and sense− signals to determine the value or state of signals out+ and out− for any signals driven to speaker 41, system 19 can determine the code configured by connections 43 and 44 at any time during the operation of system 19. For example, at any time during the method of exciting speaker 41 with audio representative signals in response to signal 22.

In some prior systems, the system could only determine information about a receiver during a start-up procedure before the system was used to send audio representative signals to the speaker. It has been found that in some such systems the start-up sequence used to determine the code in the receiver caused undesirable audio noises that were not acceptable to the hearing aid users. The audible noises may sometimes be referred to as clicks or pops or other types of noise.

However, since system 19 can monitor and determine the state or value of signals out+ and out− at any time speaker 41 is driven, controller 20 can sense the state of out+ and out− and receive the state of signals In0 and In1 and determine the codes that correspond to the out+, out−, IN0, and In1 values or states, such as is illustrated in table 50 of FIG. 4. Consequently, system 19 is not limited to driving receiver 18 only during a start-up procedure which forces the state of out+ and out−. System 19 can decode the code of receiver 18 at any time during the operation of system 19. Accordingly, system 19 minimizes undesirable audible noise during the sequence to determine the information of receiver 18 since system 19 uses the normal audio amplification or audio processing of received audio signals to determine the information of receiver 18.

Those skilled in the art will appreciate that signals out+ and out− may be used in an embodiment of component 11 (FIG. 1) to drive receiver module 16, and that an embodiment of module 16 may include a speaker similar to speaker 41. Those skilled in the art will also appreciate that in other embodiments, the output signal may be used directly as the sense signals 31 and 32 instead of forming separate sense signals.

Figure 5:
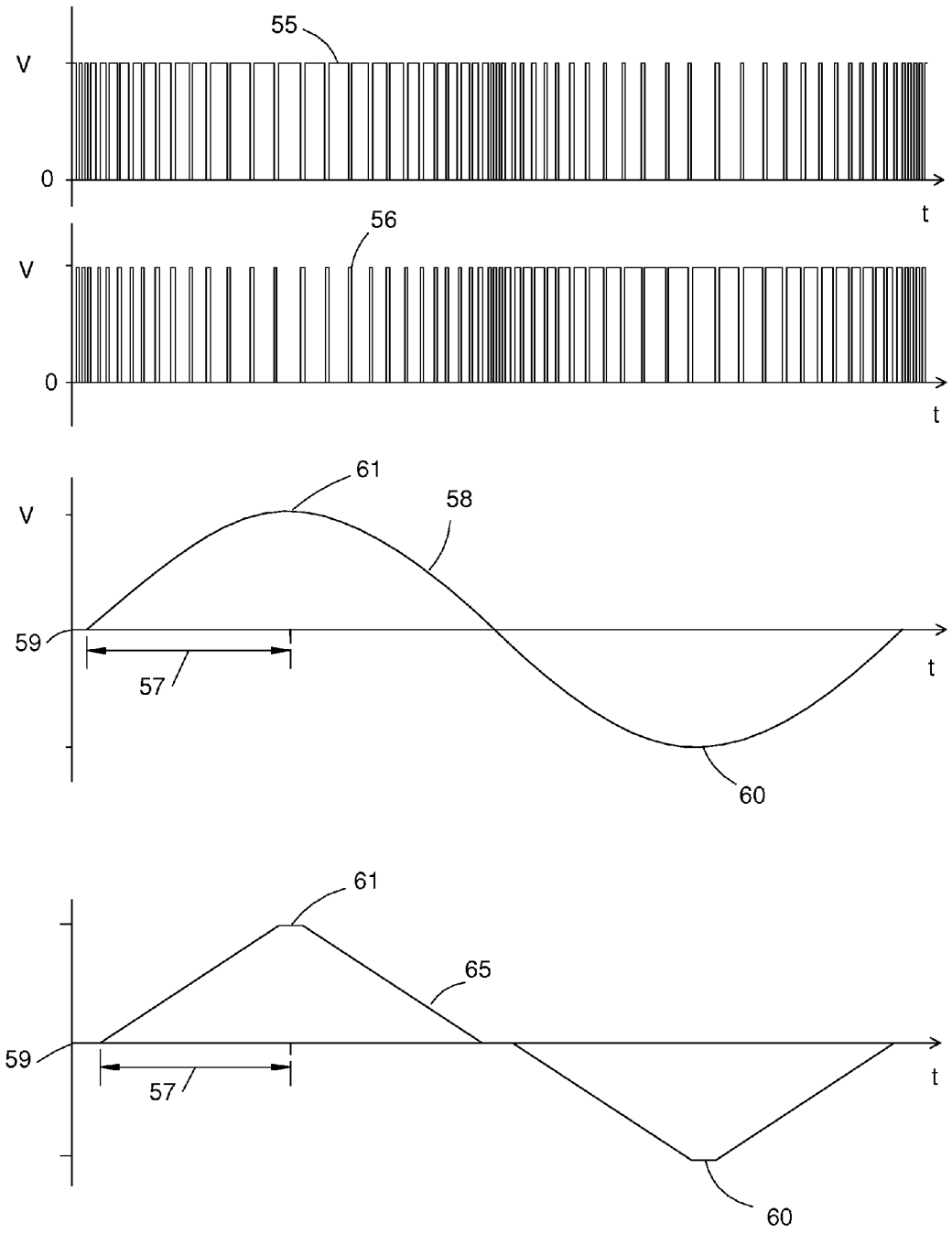
FIG. 5 illustrates a graph having plots illustrating examples of some signals that may be formed by an embodiment of the system of FIG. 1 or FIG. 2 in accordance with the present invention.

FIG. 5 illustrates a graph having plots illustrating examples of some signals that may be formed by an embodiment of system 10 or alternately system 19 for an alternate method of minimizing audible noise during a method to determine the receiver information. A plot 55 illustrates an example of values of an output signal formed to excite a speaker, such as for example signal out+ formed to excite speaker 41, relative to a common reference value, such as for example a ground reference. A plot 56 illustrates an example of values of another output signal, such as signal out−, formed to excite the speaker relative to the common reference value. A plot 58 illustrates an excitation signal at the speaker in response to the output signals illustrated by plots 55 and 56. A plot 65 illustrates an alternate embodiment of an excitation signal. The abscissa indicates time and the ordinate indicates increasing value of the illustrated signal. Those skilled in the art will appreciate that the speaker may, in some embodiments, function somewhat as a low pass filter that may shape the output signals such that the resulting waveform of the excitation signal at the speaker may have a waveshape that may be different from the waveshape of the output signals. In a non-limiting embodiment, the resulting waveshape of the excitation signal may be similar to either of plots 58 or 65, or other waveshapes. The signals of plots 55 and 56 are formed to substantially form a signal similar to plot 58. Those skilled in the art will appreciate that the output signals, such as for example signals out+ and out−, may have a different shape to form the signal illustrated by plot 65.

It has been found that applying a gradually changing excitation signal, such as having a gradually increasing or gradually decreasing value, to the speaker can minimize audible noise in the speaker. For example, the output signals may be controlled to form the excitation signal at the speaker to have the slowly varying waveform, for example having a slowly increasing value of a slowly decreasing value. In an embodiment, the controller for the system, such as for example controller 12 or 20, may be configured to control the output signals to form the gradually changing excitation signal. The waveform of plot 58 illustrates a sinusoid waveform that may be one example of a gradually changing excitation signal that minimizes audible noise. However, the controller may be configured to control the output signals to form the waveshape of the excitation signal to be similar to plot 65 or similar any other waveshape that has a gradually changing or slowly varying waveshape. It has been found that in an embodiment audible noise may be minimized if the excitation signal is formed with a sufficiently large time interval for the value of the excitation signal to rise or fall from a common mode value to a peak value, for example a quarter of a cycle. One example of such a time interval is illustrated by an arrow 57 in plots 58 and 65. The common mode value of plots 58 and 65 is illustrated by a value 59. In one example embodiment, a time interval of no less than approximately ten (10) milliseconds was found to minimize the noise. A time interval of approximately fifty (50) milliseconds was found to minimize the noise in another embodiment. Another embodiment with a time interval between approximately ten and approximately fifty (10-50) milliseconds was found to minimize the noise. It is believed that one skilled in the art would not expect to excite the speaker with the gradually changing excitation signal because the frequency of such a signal is outside the normal hearing range, thus, is outside the range typically used for exciting a speaker of a hearing aid. For example, in one embodiment the frequency of the excitation signal may be less than approximately twenty-five Hertz (25 Hz). In another embodiment, the frequency of the excitation signal may be between approximately five and approximately twenty-five Hertz (5-25 Hz).

Assume that system 19 (FIG. 2) is configured to form signals out+ and out− as PDM signals. Those skilled in the art will understand that the out+ signal generally may be formed to have more pulses than the out− signal in order to increase the value of the excitation signal, and to have fewer pulses than the out− signals in order to reduce the value of the excitation signal. The waveform of the excitation signal will be different from the waveform of the out+ and out− signals. Controller 20 may be configured to control the PDM out+ and out− signals to form the desired gradually increasing excitation signal, such as for example either waveform of plots 58 or 65, or other gradually increasing excitation signal.

In an alternate embodiment, assume that a system such as system 10 is not able to sense the value or state of the output signals, thus, such a system may have to form special output signals that are dedicated to the method of determining the receive information such as the code of the encoding connections, such as for example connections 43 and 44. Such a system may have to form the special or dedicated output signals during a start-up sequence, or in response to connecting a receiver to the component, such as connecting receiver 15 or receiver 18, to respective component 11 or controller 20. Configuring the controller of the system to control the dedicated output signals to form the excitation signal to have the gradually increasing waveform, such as illustrated by plot 58 or plot 65 for example, minimizes the audible noise formed during the detection method.

For each excitation signal waveform of plots 58 and 65, the positive peaks of the excitation signal, such as a positive peak 61, usually coincides with an asserted state of the output signal on the positive amplifier output, such as out+ for example. Positive peak 61 also usually coincides with a low voltage or negated state on the negative amplifier output, such as out− for example. At this point in the cycle, any information signals received by the controller, such as signals In0 and/or In1 for example, result from the state or value of the positive amplifier output, such as out+ for example. Conversely, peaks in the negative excursion of the excitation signal, such as for example a negative peak 60, usually coincides with an asserted state or high voltage on the negative amplifier output, such as out− for example. Negative peak 60 also usually coincides with low voltage or negated state on the positive amplifier output, such as out+ for example. At this point in the cycle, any information signals received by the controller, such as In0 and/or In1 for example, result from the state or value of the negative amplifier output, such as out− for example. Thus, the states of the positive and negative amplifier output signals can be used along with the received information signals to decode the information of the receiver, such as illustrated in table 50 of FIG. 4 for example.

Alternately, it can be seen from table 50 that only one of the output signals out+ or out− is needed at a time to determine the encoded information. For example, only the positive output out+ may be controlled to form a first slowly varying waveform and sensing the information signals followed by controlling only the negative output out− to form a second slowly varying waveform and sensing the information signals to determine the receiver information.

This encoding system can also be applied to a detachable receiver for a stereo system, or two-way loudspeaker connection. For such an embodiment, the controller 20 may be configured with a stereo amplifier and two amplifier outputs for each receiver resulting in two out+ outputs and two out− outputs. Consequently, the number of connection states may be increased to five: not connected (open), connected to the left positive-amplifier output, connected to the left negative-amplifier output, connected to the right positive-amplifier output, and connected to the right negative-amplifier output. For such a stereo system provided with n digital inputs, it is possible to encode $5^n$ unique identification states.

Figure 7:
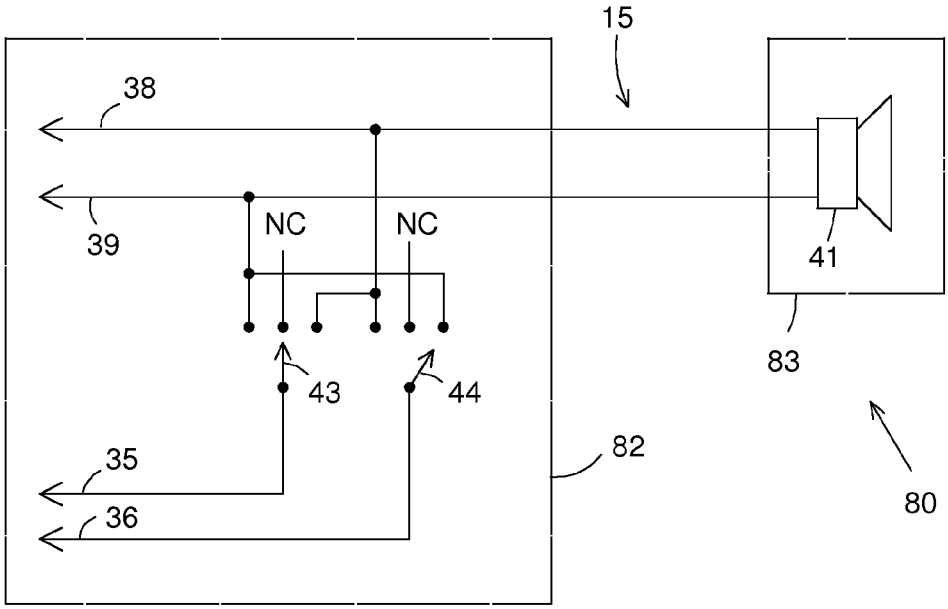
FIG. 7 schematically illustrates an example of a portion of an embodiment of a detachable receiver that may be an alternate embodiment of the detachable receiver of FIG. 1 and/or FIG. 2 in accordance with the present invention.

FIG. 7 schematically illustrates an example of a portion of an embodiment of a detachable receiver 80 that may be an alternate embodiment of either of receivers 13 or 18 of FIG. 1 or 2, respectively. Receiver 80 includes a speaker module 83 and also includes a connector 82 that may have an embodiment that may be an alternate embodiment of connector 14 (FIGS. 1 and 2). However, connector 82 may include connectors 43 and 44 disposed within connector 82 instead of in speaker module 83.

Figure 6:
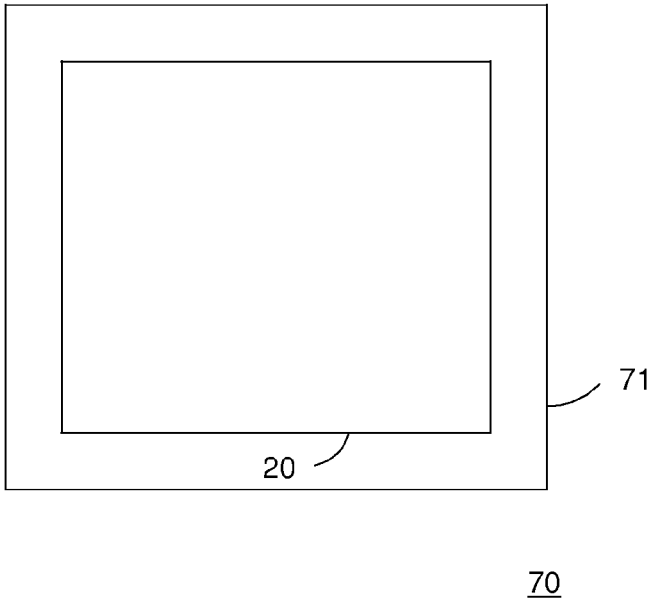
FIG. 6 illustrates an enlarged plan view of a portion of an embodiment of a semiconductor device that may include the controller of FIG. 1 or FIG. 2 in accordance with the present invention.

FIG. 6 illustrates an enlarged plan view of a portion of an embodiment of a semiconductor device or integrated circuit 70 that is formed on a semiconductor die 71. In an embodiment, any one of controllers 12 or 20 may be formed on die 71. Die 71 may also include other circuits that are not shown in FIG. 6 for simplicity of the drawing. The controller and device or integrated circuit 70 may be formed on die 71 by semiconductor manufacturing techniques that are well known to those skilled in the art.

From all of the foregoing, one skilled in the art will appreciate that in an embodiment, a semiconductor device may be configured for identification of a detachable device, for example device 13 and/or 18, may comprise:

a controller, such as for example controller 20 or circuit 21, may be configured to control one or more output signals, such as for example signals out+ and/or out−, to excite the detachable device;

a connector, such as connector 14 and/or 82, configured to couple the one or more output signals to the detachable device;

one or more information inputs, for example inputs 33 and/or 34, of the controller configured to receive one or more information signals, such as signals In0 and/or In1 for example, from the detachable device wherein the one or more information signals are selectively representative of the one or more output signals according to codes of the detachable device, for example the codes of tables 50 for example; and one or more sense inputs, for example inputs 31 and/or 32, of the controller configured to receive one or more sense signals, such as for example sense signal(s) sense+ and/or sense−, that are representative of the one or more output signals wherein the controller is configured to determine the codes according to values of the one or more sense signals and the one or more information signals.

In another embodiment, the codes of the detachable device may be formed by an interconnection configuration between the one or more output signals and the one or more information signals.

An embodiment may include, that the interconnection configuration includes a resistor or a short circuit.

Another embodiment of the semiconductor device may include that the controller may be configured to determine the codes by forming a first value for the one or more output signals, sensing a first value of the one or more sense signals and a first value of the one or more information signals, forming a second value for the one or more output signals, and sensing a second value of the one or more sense signals and a second value of the one or more information signals.

In an embodiment the semiconductor device may include using the first and second values of the one or more information signals to form a binary value that is representative of the code.

An embodiment may include that the binary value may have four binary digits.

In another embodiment the controller may be configured to control the one or more output signals to form an excitation signal to excite the detachable device wherein the excitation signal varies from a common mode value to a peak value in no less than approximately ten to approximately sixty milliseconds.

Another embodiment may include that the one or more output signals may be outputs signal from an output of an amplifier and configured to excite a loudspeaker of the detachable device.

Those skilled in the art will understand that an embodiment of a method of forming a semiconductor device may comprise:

configuring a controller, such as for example controller 12 or 20, to form output signals, such as signals out+ and out− for example, to form an excitation signal to excite a detachable device, such as receiver 13 or 18 for example;

forming the controller to receive information signals, such as signals In0 and/or In1 for example, from the detachable device wherein the information signals are selectively representative of values of the output signals according to a connection configuration of the detachable device; and forming the controller to one of a) control the output signals to form the excitation signal to vary gradually or b) receive sense signals that are representative of the output signals and use the sense signals and the information signals to decode information of the information signals.

An embodiment of the method may include configuring the controller to control the output signals to form the excitation signal to have a gradually varying rise time or gradually varying fall time.

Another embodiment of the method may include forming the controller to control the output signals to form the excitation signal to have the gradually varying rise time or fall time includes forming the controller to form the rise time or fall time to be approximately ten to fifty microseconds.

In an embodiment, the method may include forming the controller to use a value of the information signals corresponding to a peak value of the excitation signal.

In an embodiment, the method may include configuring the controller to form the excitation signal to form audio signals from the detachable device.

Those skilled in the art will appreciate that an embodiment of a method of forming a semiconductor device configured for decoding information from a detachable device may comprise:

forming a controller to form output signals to form an excitation signal to excite the detachable device;

forming the controller to receive information signals from the detachable device wherein the information signals are selectively representative of values of the output signals according to a connection configuration of the detachable device; and configuring the controller to receive sense signals that are representative of the output signals and to use values of the sense signals and values of the information signals to decode information of the information signals.

The method may have an embodiment that may include configuring the controller to form the output signal to form the excitation signal with a gradually changing value.

In another embodiment, the method may include configuring the controller to form the excitation signal with a frequency that is outside a normal hearing range.

An embodiment may include configuring the controller to form the excitation signal with a frequency that is less than approximately one hundred Hertz.

Another embodiment my include configuring the controller to form the excitation signal with a frequency that is less than approximately twenty Hertz.

An embodiment of the method may include configuring the controller to form output signals of opposite states, to receive the sense signals that are representative of the output signal and the input signals formed from the output signals, to invert the output signals, and to receive the sense signals that are representative of the inverted output signals and the input signals formed from the inverted output signals.

In another embodiment, the method may include configuring the controller to decode information of the information signals during the operation of forming audible signals for a user of the semiconductor device.

In view of all of the above, it is evident that a novel device and method is disclosed. Included, among other features, is forming a device that can reduce audible noise. For example, reduce audible noise during a method of identifying information from a detachable receiver. Such as for example, receiving information from a detachable receiver. The device may have an embodiment that receives signals representative of output signals and receive one or more sense signals representative of information coded into the receiver. An embodiment may include that the sense signals and information signals may be received while the device is sending signals representative of received audio signals to the detachable receiver.

While the subject matter of the descriptions are described with specific preferred embodiments and example embodiments, the foregoing drawings and descriptions thereof depict only typical and non-limiting examples of embodiments of the subject matter and are not therefore to be considered to be limiting of its scope, it is evident that many alternatives and variations will be apparent to those skilled in the art. Those skilled in the art will appreciate that although the foregoing example embodiments of a hearing aid are used as a vehicle for explaining the drawings, the embodiments can be used in other types of amplification devices such as for example personal sound amplifications. One example of a personal amplification device is a hunters earplug. Brand names such as Walker's Game Ear or Ultra Ear are examples of personal amplification devices. Also, those skilled in the art will appreciate that although the herein example of a hearing aid illustrates two information signals In0 and In1 and two corresponding terminals, system 10 or controller 20 may include only one or may include more than two information signals and only one or more than two connections, such as connections 43 and 44. Although connections 43 and 44 are illustrated as conductors that form connections from terminals 38 and 39 to 35 and 36, those skilled in the art will appreciate that the connections may be formed by various means including, for example, switches or hardwired connections or resistors.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

The invention claimed is:

1. A semiconductor device configured for identification of a detachable device, comprising:

a controller configured to control one or more output signals to excite the detachable device;

one or more information inputs of the controller configured to receive one or more information signals from the detachable device wherein the one or more information signals are selectively representative of the one or more output signals according to codes of the detachable device; and one or more sense inputs of the controller configured to receive one or more sense signals that are representative of the one or more output signals wherein the controller is configured to determine the codes according to values of the one or more sense signals and the one or more information signals.

2. The semiconductor device of claim 1 wherein the codes of the detachable device are formed by an interconnection configuration between the one or more output signals and the one or more information signals.

3. The semiconductor device of claim 2 wherein the interconnection configuration includes a resistor or a short circuit.

4. The semiconductor device of claim 1 wherein the controller is configured to determine the codes by forming a first value for the one or more output signals, sensing a first value of the one or more sense signals and a first value of the one or more information signals, forming a second value for the one or more output signals, and sensing a second value of the one or more sense signals and a second value of the one or more information signals.

5. The semiconductor device of claim 4 further including using the first and second values of the one or more information signals to form a binary value that is representative of the code.

6. The semiconductor device of claim 5 wherein the binary value has four binary digits.

7. The semiconductor device of claim 1 further including the controller configured to control the one or more output signals to form an excitation signal to excite the detachable device wherein the excitation signal varies from a common mode value to a peak value in no less than approximately ten to approximately sixty milliseconds.

8. The semiconductor device of claim 1 wherein the one or more output signals are outputs signal from an output of an amplifier and configured to excite a loudspeaker of the detachable device.

9. A method of forming a semiconductor device comprising:

configuring a controller to form output signals to form an excitation signal to excite a detachable device;

forming the controller to receive information signals from the detachable device wherein the information signals are selectively representative of values of the output signals according to a connection configuration of the detachable device; and forming the controller to one of a) control the output signals to form the excitation signal to vary gradually or b) receive sense signals that are representative of the output signals and use the sense signals and the information signals to decode information of the information signals.

10. The method of claim 9 wherein the step of forming the controller to one of control the output signals to form the excitation signal to vary gradually includes forming the controller to control the output signals to form the excitation signal to have a gradually varying rise time or gradually varying fall time.

11. The method of claim 10 wherein forming the controller to control the output signals to form the excitation signal to have the gradually varying rise time or fall time includes forming the controller to form the rise time or fall time to be approximately ten to fifty microseconds.

12. The method of claim 10 wherein forming the controller to control the output signals to form the excitation signal to have the gradually varying rise time or fall time includes forming the controller to use a value of the information signals corresponding to a peak value of the excitation signal.

13. The method of claim 9 wherein configuring the controller to form output signals to form the excitation signal includes configuring the controller to form the excitation signal to form audio signals from the detachable device.

14. A method of forming a semiconductor device configured for decoding information from a detachable device comprising:

forming a controller to form output signals to form an excitation signal to excite the detachable device;

forming the controller to receive information signals from the detachable device wherein the information signals are selectively representative of values of the output signals according to a connection configuration of the detachable device; and configuring the controller to receive sense signals that are representative of the output signals and to use values of the sense signals and values of the information signals to decode information of the information signals.

15. The method of claim 14 including configuring the controller to form the output signal to form the excitation signal with a gradually changing value.

16. The method of claim 14 wherein forming the controller to form output signals includes configuring the controller to form the excitation signal with a frequency that is outside a normal hearing range.

17. The method of claim 14 wherein forming the controller to form output signals includes configuring the controller to form the excitation signal with a frequency that is less than approximately one hundred Hertz.

18. The method of claim 14 wherein forming the controller to form output signals includes configuring the controller to form the excitation signal with a frequency that is less than approximately twenty Hertz.

19. The method of claim 14 wherein forming the controller to form output signals includes configuring the controller to form output signals of opposite states, to receive the sense signals that are representative of the output signal and the input signals formed from the output signals, to invert the output signals, and to receive the sense signals that are representative of the inverted output signals and the input signals formed from the inverted output signals.

20. The method of claim 14 wherein configuring the controller to receive sense signals that are representative of the output signals includes configuring the controller to decode information of the information signals during the operation of forming audible signals for a user of the semiconductor device.

* * * * *